US010711803B2

(12) United States Patent
Kiuchi

(10) Patent No.: US 10,711,803 B2
(45) Date of Patent: Jul. 14, 2020

(54) PACKAGED COMPRESSOR

(71) Applicant: Kobe Steel, Ltd., Hyogo (JP)

(72) Inventor: Suguru Kiuchi, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 98 days.

(21) Appl. No.: 16/064,787

(22) PCT Filed: Nov. 18, 2016

(86) PCT No.: PCT/JP2016/084305
§ 371 (c)(1),
(2) Date: Jun. 21, 2018

(87) PCT Pub. No.: WO2017/115585
PCT Pub. Date: Jun. 7, 2017

(65) Prior Publication Data

US 2019/0003490 A1 Jan. 3, 2019

(30) Foreign Application Priority Data

Dec. 28, 2015 (JP) ..... 2015-255616

(51) Int. Cl.
*F04D 29/66* (2006.01)
*F04D 17/16* (2006.01)
(Continued)

(52) U.S. Cl.
CPC ..... *F04D 29/664* (2013.01); *F04B 39/0038* (2013.01); *F04B 39/066* (2013.01);
(Continued)

(58) Field of Classification Search
CPC .. F04D 29/664; F04D 29/5826; F04D 25/166; F04D 19/002; F04D 17/16; F04B 41/00; F04B 39/066; F04B 39/0038
(Continued)

(56) References Cited

U.S. PATENT DOCUMENTS 1,865,677 A * 7/1932 Cheyney ..... F24F 13/24 454/370
2,148,388 A 2/1939 Wyld
(Continued)

FOREIGN PATENT DOCUMENTS

CN 203374522 U 1/2014
JP 56154118 A * 11/1981
(Continued)

OTHER PUBLICATIONS

International Search Report issued in PCT/JP2016/084305; dated Jan. 24, 2017.
(Continued)

*Primary Examiner* — J. Todd Newton
(74) *Attorney, Agent, or Firm* — Studebaker & Brackett PC

(57) ABSTRACT

The packaged compressor includes inside a package: a compressor main body compressing air; a cooling fan; a fan cover attached to the cooling fan and opened to a suction side and to an upward direction being a delivery side of the cooling fan; an exhaust duct provided above a delivery side opening of the fan cover and extending in a vertical direction; and an air-cooled heat exchanger arranged to be inclined with respect to a vertical direction inside the exhaust duct and configured to exchange heat between air compressed by the compressor main body and air delivered by the cooling fan.

10 Claims, 3 Drawing Sheets

(51) Int. Cl.

| | |
|---|---|
| ***F04D 19/00*** | (2006.01) |
| ***F04B 39/06*** | (2006.01) |
| ***F04B 39/00*** | (2006.01) |
| ***F04D 25/16*** | (2006.01) |
| ***F04D 29/58*** | (2006.01) |
| *F04B 41/00* | (2006.01) |

(52) U.S. Cl.
CPC ..... *F04D 17/16* (2013.01); *F04D 19/002* (2013.01); *F04D 25/166* (2013.01); *F04D 29/5826* (2013.01); *F04B 41/00* (2013.01)

(58) Field of Classification Search
USPC ..... 415/177
See application file for complete search history.

(56) References Cited

U.S. PATENT DOCUMENTS 2,185,718 A 1/1940 Anderson
3,421,687 A * 1/1969 Daily ..... F04D 29/526 415/121.2
4,449,376 A * 5/1984 Draper ..... F25B 39/00 62/259.1
5,663,536 A * 9/1997 Kaplan ..... F28C 1/10 181/224
5,916,253 A * 6/1999 Amr ..... B60H 1/00428 62/239
5,983,888 A 11/1999 Anselmino et al.
6,273,213 B1 * 8/2001 Callas ..... G10K 11/16 181/200
6,481,527 B1 * 11/2002 French ..... G10K 11/16 181/198
7,314,113 B2 * 1/2008 Doll ..... E04F 17/04 165/135
7,845,463 B2 * 12/2010 Yabe ..... F01N 1/10 181/198
2006/0280626 A1 * 12/2006 Nishimura ..... F01C 21/007 417/410.4
2008/0223345 A1 * 9/2008 Hummel ..... F02B 29/0462 123/542
2010/0135840 A1 * 6/2010 Fujimoto ..... F04B 39/0033 418/201.1
2010/0251753 A1 10/2010 Thogersen et al.
2012/0292008 A1 * 11/2012 Goldberg ..... D06F 95/00 165/287
2017/0059188 A1 * 3/2017 Hancock ..... F24F 1/0059
2019/0309626 A1 * 10/2019 Yano ..... F01C 21/06

FOREIGN PATENT DOCUMENTS

JP H08-128663 A 5/1996
JP 08200271 A * 8/1996
JP H10-30594 A 2/1998
JP 2005-30227 A 2/2005
JP 2005030227 A * 2/2005
JP 2005-171957 A 6/2005
JP 2010-127234 A 6/2010
JP 2017120025 A * 7/2017 ..... F04B 39/0038
JP 2018204521 A * 12/2018

OTHER PUBLICATIONS

The extended European search report issued by the European Patent Office dated Jun. 26, 2019, which corresponds to European Patent Application No. 16881565.2 and is related to U.S. Appl. No. 16/064,787.
International Preliminary Report on Patentability issued in corresponding International Application No. PCT/JP2016/084305; dated Jul. 12, 2018.

* cited by examiner

PACKAGED COMPRESSOR

CROSS-REFERENCE TO RELATED APPLICATIONS

This is a national phase application in the United States of International Patent Application No. PCT/JP2016/084305 with an international filing date of Nov. 18, 2016, which claims priority of Japanese Patent Application No. 2015-255616 filed on Dec. 28, 2015 the contents of which are incorporated herein by reference.

TECHNICAL FIELD

The present invention relates to a packaged compressor.

BACKGROUND ART

Packaged compressors are known in which components such as a compressor main body, a cooling fan, and a heat exchanger are housed in one package, so that the degree of freedom and convenience of installation are improved (for example, see JP 2010-127234 A). Inside the packaged compressor, for example, noise caused by the fan is generated. The package is also effective for preventing such internal noise from leaking outside, and a low-noise packaged compressor is desired.

SUMMARY OF THE INVENTION

Problems to be Solved by the Invention

However, when a fan is installed at a position directly viewable from the exhaust port of the exhaust duct as the packaged compressor described in JP 2010-127234 A, noise easily leaks outside the package. In addition, in the packaged compressor described in JP 2010-127234 A, no particular contrivance is made for the space saving of the arrangement of the fan and the heat exchanger, and there is room for down-sizing.

An object of the present invention is noise reduction and down-sizing of a packaged compressor.

Means for Solving the Problems

The present invention provides a packaged compressor including inside a package: a compressor main body compressing air; a cooling fan; a fan cover attached to the cooling fan and opened to a suction side and to an upward direction being a delivery side of the cooling fan; an exhaust duct provided above a delivery side opening of the fan cover and extending in a vertical direction; and an air-cooled heat exchanger arranged to be inclined with respect to a vertical direction inside the exhaust duct and configured to exchange heat between air compressed by the compressor main body and air delivered by the cooling fan.

According to this configuration, the fan cover limits the exposure area of the cooling fan to regulate the direction of noise conduction. Since the air-cooled heat exchanger is arranged between the delivery side opening and the exhaust port in the regulated direction, the noise does not directly leak out of the package, and the noise emitted to the outside of the package can be reduced. Specifically, the delivery direction of air by the cooling fan is regulated in the upward direction, and the air-cooled heat exchanger is provided at the downstream of the delivery, which is arranged to be inclined with respect to the vertical direction (delivery direction). Therefore, the air delivered upward by the cooling fan is deflected so that its flowing direction is inclined when passing through the air-cooled heat exchanger, thereby no noise directly leaks from the exhaust port. In other words, the cooling fan is configured so that the cooling fan cannot be viewed when the inside of the package is viewed from the exhaust port. In addition, the inclined arrangement of the air-cooled heat exchanger with respect to the vertical direction inside the exhaust duct also contributes to reducing the flow passage area inside the exhaust duct and down-sizing of the whole.

It is preferable that a suction side opening of the fan cover opens to a horizontal direction, and the package includes an intake port for introducing cooling air in a height position where the cooling fan cannot be directly viewed through the suction side opening.

Noise does not directly leak out of the package from the intake port so that the noise emitted to the outside of the package can be reduced. Here, the horizontal direction also includes a direction inclined to such a degree that the cooling fan can fulfill its function in addition to the strict horizontal direction.

It is preferable that a sound insulating plate installed in a vertical direction on an upper side of the air-cooled heat exchanger inside the exhaust duct is further included.

The sound insulation plate can prevent the noise from the cooling fan from directly leaking out of the package, so that the noise emitted to the outside of the package can be reduced. In addition, since the sound insulation plate is vertically installed substantially along the flow of air inside the exhaust duct, the flow of air inside the exhaust duct is not significantly disturbed.

It is preferable that the sound insulating plate is installed so as to cross a ventilation direction of the air-cooled heat exchanger.

Since the sound insulation plate is installed so as to cross the ventilation direction of the air-cooled heat exchanger for blocking the noise from the cooling fan from leaking out of the package, the noise from the cooling fan can be prevented from directly leaking out of the package, and the noise emitted to the outside of the package can be reduced. The ventilation direction here indicates the direction in which the air delivered by the cooling fan passes through the air-cooled heat exchanger.

It is preferable that a sound absorbing material is stuck to the sound insulating plate.

Sticking the sound absorbing material to the sound insulating plate allows the sound insulating plate to attenuate the noise energy and the noise emitted to the outside of the package to be further reduced.

It is preferable that a sound absorbing material is stuck to an inner surface of the exhaust duct on a downstream side of the air-cooled heat exchanger.

Sticking the sound absorbing material to the inner surface of the exhaust duct allows the inner surface of the exhaust duct to attenuate the noise energy and the noise emitted to the outside of the package to be further reduced.

According to the present invention, in the packaged compressor, since the fan cover regulates the direction of noise conduction of the cooling fan, and the air-cooled heat exchanger is arranged between the delivery side opening and the exhaust port, noise caused by the cooling fan does not directly leak out of the package. Therefore, the noise emitted to the outside of the package can be reduced. In addition, the inclined arrangement of the air-cooled heat exchanger with respect to the vertical direction inside the exhaust duct can reduce the flow passage area inside the exhaust duct and can downsize the whole.

MODE FOR CARRYING OUT THE INVENTION

In the following, embodiments of the present invention will be described with reference to the accompanying drawings.

Figure 1:
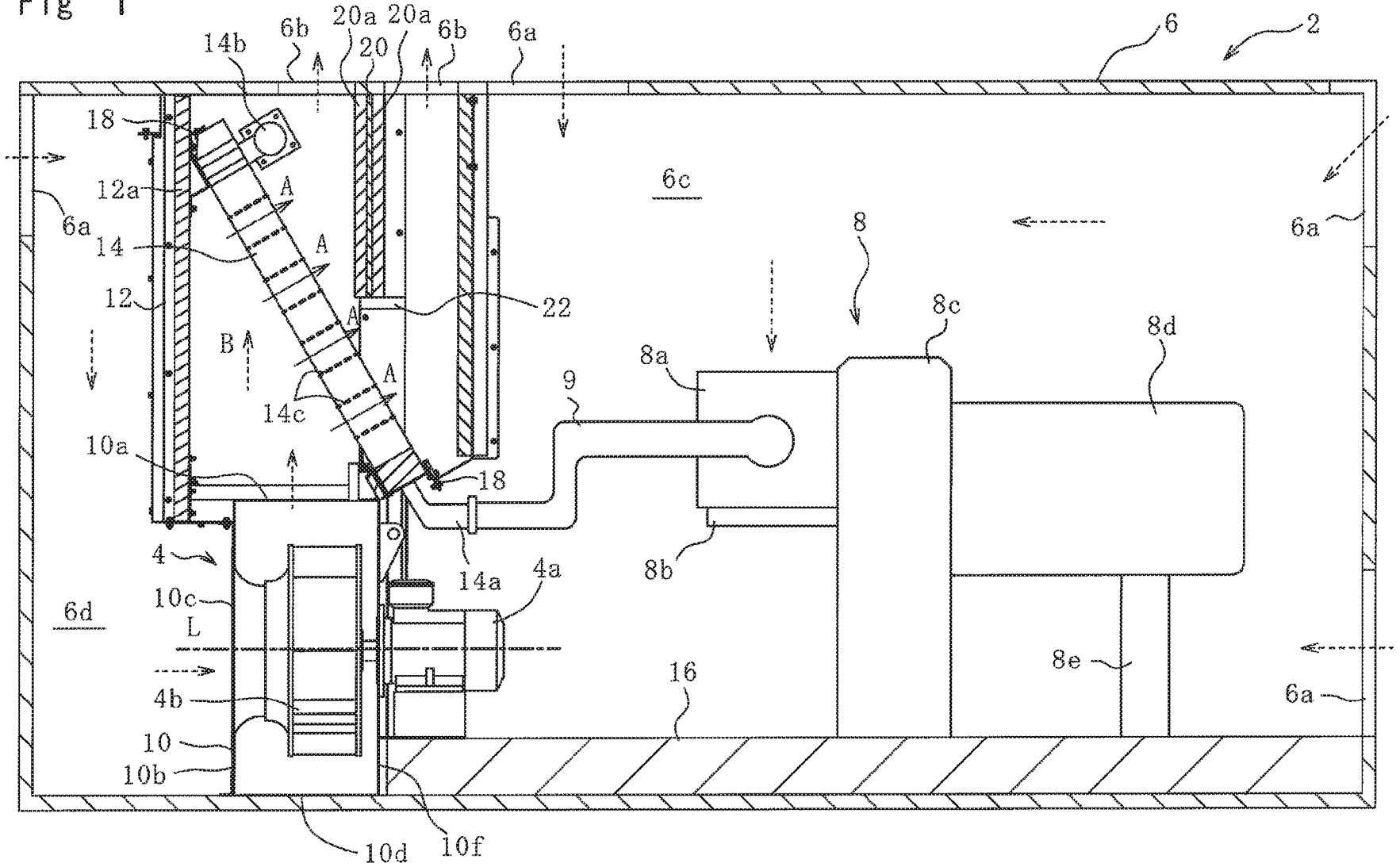
FIG. 1 is a schematic configuration diagram of a packaged compressor according to an embodiment of the present invention.

Referring to FIG. 1, a packaged compressor 2 of the present embodiment includes a box package 6. The inside of the package 6 is provided with a compressor main body 8, a turbo fan 4 being an example of a cooling fan, a fan cover 10 of the turbo fan 4, an exhaust duct 12, and an air-cooled heat exchanger 14.

The package 6 is formed of a metal plate such as a steel plate and includes an intake port 6*a* and an exhaust port 6*b*. A filter (not shown) is attached to the intake port 6*a*, and air is introduced into the package 6 with foreign matters such as dust removed. The inside of the package 6 is divided into a compression chamber 6*c* and an air cooling chamber 6*d*. The compression chamber 6*c* and the air cooling chamber 6*d* are partitioned with the exhaust duct 12 and the fan cover 10 of the turbo fan 4 so that air does not directly come in and out.

First, the configuration in the compression chamber 6*c* will be described.

In the present embodiment, the compressor main body 8 is of a two-stage screw. The compressor main body 8 is arranged on a base 16 in the compression chamber 6*c* inside the package 6. The compressor main body 8 includes a first-stage compressor main body 8*a*, a second-stage compressor main body 8*b*, a gear box 8*c*, and a compressor motor 8*d*. The gear box 8*c* is fixed to the base 16, and the compressor motor 8*d* is fixed to the base 16 via a support member 8*e*. The first-stage compressor main body 8*a* and the second-stage compressor main body 8*b* are mechanically connected to the compressor motor 8*d* via the gear box 8*c*, and each of them includes a pair of male and female screw rotors (not shown) inside. The first-stage compressor main body 8*a* and the second-stage compressor main body 8*b* compress air with the screw rotors being rotationally driven by the compressor motor 8*d*. Due to the compression heat generated during compression, the temperature of the compressed air is high. The discharge port of the first-stage compressor main body 8*a* and the intake port of the second-stage compressor main body 8*b* are fluidly connected to each other with piping (not shown). The discharge port of the second-stage compressor main body 8*b* is fluidly connected to an inlet port 14*a* of the air-cooled heat exchanger 14 through a pipe 9.

Furthermore, the flow of air in the compression chamber 6*c* will be described (see broken line arrows in the drawing).

Air (cooling air) is introduced from the outside of the package 6 into the package 6 by the compressor main body 8 through the intake port 6*a*. The introduced air is sucked into the first-stage compressor main body 8*a* to be compressed, and then is sent to the second-stage compressor main body 8*b*, and further compressed. The high-pressure and high-temperature air after being compressed by the compressor main body 8 is supplied to the inlet port 14*a* of the air-cooled heat exchanger 14 through the pipe 9. The high-pressure and high-temperature air introduced from the inlet port 14*a* of the air-cooled heat exchanger 14 is cooled in the air-cooled heat exchanger 14, and then is discharged from the outlet port 14*b* to the outside of the package 6.

Next, the configuration in the air cooling chamber 6*d* described.

The turbo fan 4 is arranged in the lower part of the air cooling chamber 6*d* inside the package 6 so that a rotation axis L extends in the horizontal direction with the fan cover 10 attached. Here, the horizontal direction also includes a direction inclined to such a degree that the turbo fan 4 can fulfill its function in addition to the strict horizontal direction. The turbo fan 4 includes a fan motor 4*a*, and the fan motor 4*a* is placed on the base 16. The turbo fan 4 is driven by the fan motor 4*a* and causes the air in the air cooling chamber 6*d* to flow from the intake port 6*a* to the exhaust port 6*b*. In the present embodiment, the turbo fan 4, which is one of the centrifugal fans, is used as the cooling fan, but a sirocco fan may be substituted. In addition, although the configuration in the air cooling chamber 6*d* is described here, the fan motor 4*a* is arranged inside the compression chamber 6*c*.

Figure 2:
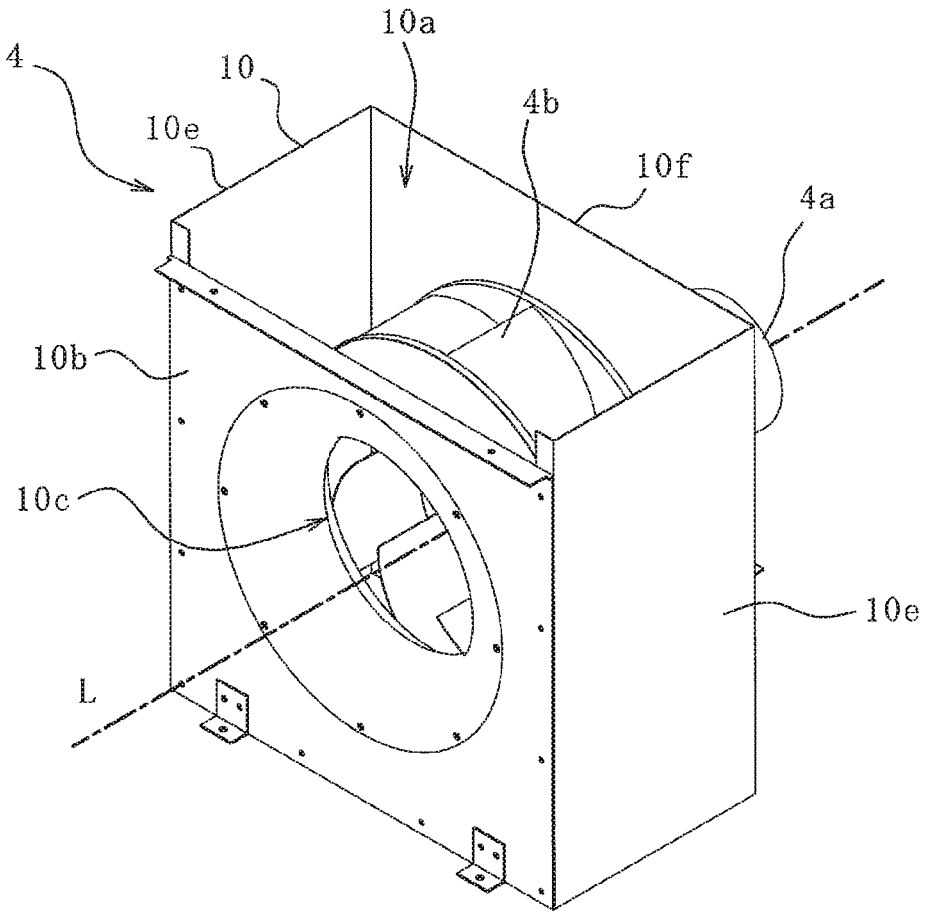
FIG. 2 is a perspective view of a cooling fan in FIG. 1.

Referring also to FIG. 2, the fan cover 10 is box-shaped, and is provided with a rectangular-shaped delivery side opening 10*a* with the top plate removed, and the front plate 10*b* is provided with a suction side opening 10*c* which is circular-shaped according to the shape of the circular blades 4*b* of the turbo fan 4 and has approximately the same size as the outer diameter of the blades 4*b*. That is, the fan cover 10 is opened to the horizontal direction being the suction direction of the turbo fan 4 and to the upward direction being the delivery direction with attached to the turbo fan 4. Except for the suction side opening 10*c*, the other directions are closed with the bottom plate 10*d*, the side plates 10*e*, and the rear plate 10*f*. The delivery side opening 10*a* of the fan cover 10 is positioned inside the lower end opening of the exhaust duct 12 extending in the vertical direction (substantially vertical). In addition, with respect to the suction side opening 10*c* of the fan cover 10, the intake ports 6*a* of the package 6 are provided at height positions where the turbo fan 4 cannot be viewed directly through the suction side opening 10*c*. Thus, noise does not directly leak out of the package 6 from the intake port 6*a*, and the noise emitted to the outside of the package 6 can be reduced.

The exhaust duct 12 guides the air delivered by the turbo fan 4 to the exhaust port 6*b*. Therefore, the lower end of the exhaust duct 12 is connected to the fan cover 10 of the turbo fan 4, and the upper end thereof is connected to the upper surface and the exhaust port 6*b* of the package 6. A sound absorbing material 12*a* is stuck to the inner surface of the exhaust duct 12. The sound absorbing material 12*a* is a spongy soft member, and absorbs noise energy to attenuate the noise energy. In particular, it is preferable that the sound absorbing material 12*a* is stuck to the downstream side of the air-cooled heat exchanger 14 in the exhaust duct 12. In addition, the air-cooled heat exchanger 14 is arranged inside the exhaust duct 12.

The air-cooled heat exchanger 14 is arranged in the exhaust duct 12 to be inclined with respect to the vertical direction, and is bolted to the exhaust duct 12 via a stopper 18. In the air-cooled heat exchanger 14, heat is exchanged between the air compressed by the compressor main body 8 and the air delivered by the turbo fan 4. The air compressed by the compressor main body 8 is cooled by heat exchange, and the air delivered by the turbo fan 4 is heated.

In the air-cooled heat exchanger 14, the air compressed by the compressor main body 8 is introduced from the inlet port 14*a* into the air-cooled heat exchanger 14 as described above, and is led out from the outlet port 14*b* through tubes (not shown). The air delivered by the turbo fan 4 passes between the above tubes of the air-cooled heat exchanger 14 from the bottom to the top, and the flow direction is changed, by a fin 14*c* indicated by broken lines, from the substantially upward direction (arrow B) to the ventilation direction indicated by the arrow A in the drawing. That is, the ventilation direction A indicates the direction in which the air delivered by the turbo fan 4 passes through the air-cooled heat exchanger 14.

In the exhaust duct 12, a sound insulating plate 20, which is a metal plate, is installed vertically (substantially vertically) on the upper side (downstream side in the ventilation direction A) of the air-cooled heat exchanger 14. In addition, the sound insulating plate 20 is installed so as to cross the ventilation direction A of the air-cooled heat exchanger 14. The sound insulating plate 20 has an upper end fixed to the upper surface of the package 6 and a lower end fixed to a support table 22 fixed to the inner surface of the exhaust duct 12. Sound absorbing materials 20*a* similar to the sound absorbing material stuck to the inner surface of the exhaust duct 12 are stuck to both surfaces of the sound insulating plate 20. That is, the sound insulating plate 20 is sandwiched between two sound absorbing materials 20*a*.

Furthermore, the flow of air in the air cooling chamber 6*d* will be described (see the broken line arrow in the drawing).

Air is introduced from the outside of the package 6 into the package 6 by the turbo fan 4 through the intake port 6*a*. The introduced air is sucked into the turbo fan 4 in the direction of the rotation axis L (horizontal direction), and is delivered upward into the exhaust duct 12 together with the noise. The air delivered into the exhaust duct 12 passes through the air-cooled heat exchanger 14 and is deflected to the ventilation direction A during passing through. The air deflected to the ventilation direction A is exhausted from the exhaust port 6*b* to the outside of the package 6 after its noise energy is absorbed on the sound insulating plate 20 and the inner surface of the exhaust duct 12 to which the sound absorbing material is stuck.

According to the present embodiment, the fan cover 10 limits the exposure area of the turbo fan 4 to regulate the direction of noise conduction. Since the air-cooled heat exchanger 14 is arranged between the delivery side opening 10*a* and the exhaust port 6*b* in the regulated direction, the noise does not directly leak out of the package 6, and the noise emitted to the outside of the package 6 can be reduced. Specifically, the direction of air delivery by the turbo fan 4 is regulated in the upward direction, and the delivery destination is provided with an air-cooled heat exchanger 14 that is arranged to be inclined with respect to the vertical direction (crossing the delivery direction). Therefore, the air delivered upward by the turbo fan 4 is deflected to the ventilation direction A when passing through the air-cooled heat exchanger 14, so that no noise directly leaks from the exhaust port 6*b*. In other words, when the inside of the package 6 is viewed from the exhaust port 6*b*, the turbo fan 4 is configured to be hidden behind the fin 14*c* of the air-cooled heat exchanger 14, that is, not to be seen. In addition, the inclined arrangement of the air-cooled heat exchanger 14 with respect to the vertical direction inside the exhaust duct 12 also contributes to reducing the flow passage area inside the exhaust duct 12 and down-sizing of the whole.

It should be noted that the generated drain may contain NOx and SOx based on the installation environment and the component of the sucked air of the packaged compressor 2. When the air-cooled heat exchanger 14 is horizontally arranged, drain is likely to stagnate in the compressed air side flow passage and corrosion due to NOx and SOx components contained in the generated drain is likely to occur, but the inclined arrangement improves this. The inclined arrangement easily concentrates the drain generated during the cooling process of the compressed air downward, and not only can contribute to facilitating the draining work, but also can prevent the corrosion of the air-cooled heat exchanger 14 caused by the stagnation of the drain. It is preferable to provide a drain tank in the lower part of the air-cooled heat exchanger 14 arranged in an inclined manner. Providing a drain hole at the lowest position of the drain tank allows draining to be more reliably performed. Making the thickness of the drain tank larger than other parts of the air-cooled heat exchanger 14 can prevent a hole due to corrosion from occurring, but if the drain tank is made of a material having good corrosion resistance against drainage, the thickness of the drain tank can be made small.

In addition, the sound insulating plate 20 can prevent the noise from the turbo fan 4 from directly leaking out of the package 6, so that the noise emitted to outside of the package 6 can be reduced. Furthermore, since the sound insulating plate 20 is vertically installed substantially along the flow of air inside the exhaust duct 12, the flow of air inside the exhaust duct 12 is not significantly disturbed.

In addition, the sound insulating plate 20 is installed so as to cross the ventilation direction A of the air-cooled heat exchanger 14 so that the noise from the turbo fan 4 is prevented from leaking out of the package 6. Therefore, the noise from the turbo fan 4 can be prevented from directly leaking out of the package 6, so that the noise emitted to the outside of the package 6 can be reduced.

In addition, sticking the sound absorbing material 20*a* to the sound insulating plate 20 allows the sound insulating plate 20 to attenuate the noise energy and the noise emitted to the outside of the package 6 to be further reduced.

In addition, sticking the sound absorbing material 12*a* to the inner surface of the exhaust duct 12 allows the inner surface of the exhaust duct 12 to attenuate the noise energy and the noise emitted to the outside of the package 6 to be further reduced.

Figure 3:
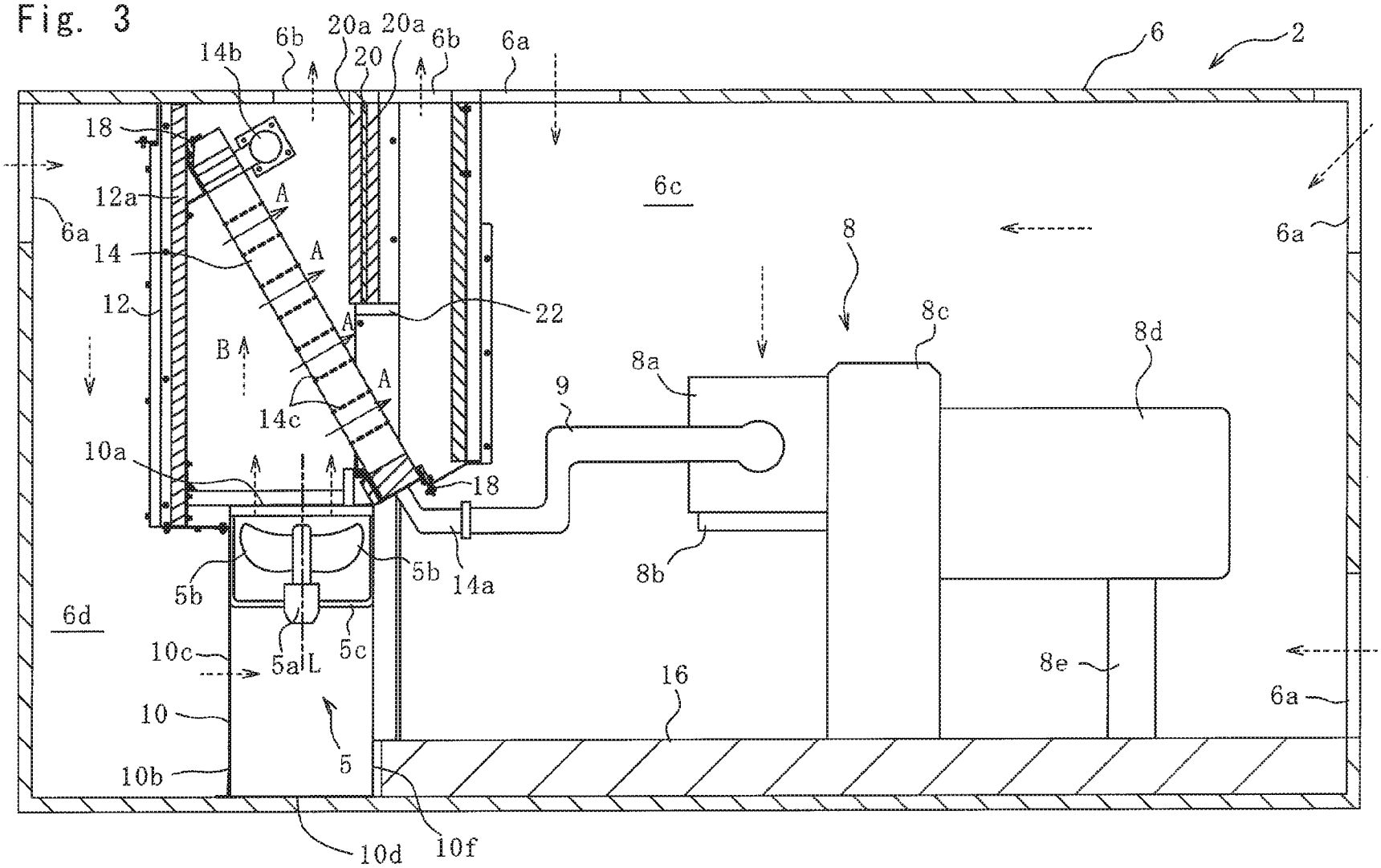
FIG. 3 is a schematic configuration diagram showing a modification of the packaged compressor in FIG. 1.

In the following, a modification of the present embodiment will be described with reference to FIG. 3.

In the present modification, an axial flow fan 5 is used as another example of the cooling fan. Since the other configuration is the same as that of the packaged compressor 2 shown in FIG. 1, components similar to the components in FIG. 1 are denoted by the same reference numerals as the reference numerals in FIG. 1, and description thereof is omitted.

The axial flow fan 5 is arranged in the lower part of the air cooling chamber 6*d* inside the package 6 so that the rotation axis L extends in the vertical direction (substantially vertical) with the fan cover 10 attached. The axial flow fan 5 includes a fan motor 5*a* and a plurality of blades 5*b* driven by the fan motor 5*a*. The fan motor 5*a* is fixed to the fan cover 10 via a fixing member 5*c*.

The fan cover 10 is attached to the axial flow fan 5 as described above, and includes a suction side opening 10*c* opening in the horizontal direction and a delivery side opening 10*a* opening upward. The other directions are closed by the bottom plate 10*d*, the side plate 10*e*, and the rear plate 10*f*. In the present modification, the suction side opening 10*c* opens to one direction in the horizontal direction, but the opening direction of the suction side opening 10*c* is not particularly limited.

The flow of air in the air cooling chamber 6*d* is the same as that of the packaged compressor 2 shown in FIG. 1 (see broken line arrows).

Thus, the type of the cooling fan of the present invention is not limited, and an axial flow fan can be used in addition to the centrifugal fan. It should be noted that the number of cooling fans is not particularly limited, and a plurality of cooling fans may be arranged in parallel.

The invention claimed is:

1. A packaged compressor comprising inside a package:

a base having a flat surface;

a compressor main body placed on the base for compressing air;

a cooling fan;

a fan cover attached to the cooling fan and opened to a suction side and to an upward direction being a delivery side of the cooling fan;

an exhaust duct provided above a delivery side opening of the fan cover and extending to an exhaust port in a perpendicular direction to the flat surface of the base and an air-cooled heat exchanger arranged to be inclined with respect to the perpendicular direction between the cooling fan and the exhaust port inside the exhaust duct so that the cooling fan cannot be directly viewed from the exhaust port and configured to exchange heat between air compressed by the compressor main body and air delivered by the cooling fan.

2. The packaged compressor according to claim 1, wherein a suction side opening of the fan cover opens to a horizontal direction, and the package includes an intake port for introducing cooling air in a height position where the cooling fan cannot be directly viewed through the suction side opening.

3. The packaged compressor according to claim 1, further comprising a sound insulating plate installed in the perpendicular direction on an upper side and delivered air exit side of the air-cooled heat exchanger inside the exhaust duct.

4. The packaged compressor according to claim 3, wherein the sound insulating plate is installed so as to cross the delivered air having passed through the air-cooled heat exchanger.

5. The packaged compressor according to claim 4, wherein a sound absorbing material is stuck to the sound insulating plate.

6. The packaged compressor according to claim 4, wherein a sound absorbing material is stuck to an inner surface of the exhaust duct on a downstream side of the air-cooled heat exchanger.

7. The packaged compressor according to claim 1, wherein a sound absorbing material is stuck to an inner surface of the exhaust duct on a downstream side of the air-cooled heat exchanger.

8. The packaged compressor according to claim 2, further comprising a sound insulating plate installed in the perpendicular direction on an upper side of the air-cooled heat exchanger inside the exhaust duct.

9. The packaged compressor according to claim 5, wherein a sound absorbing material is stuck to an inner surface of the exhaust duct on a downstream side of the air-cooled heat exchanger.

10. The packaged compressor according to claim 2, wherein a sound absorbing material is stuck to an inner surface of the exhaust duct on a downstream side of the air-cooled heat exchanger.

* * * * *